United States Patent [19]

Dietz

[11] 4,131,065

[45] Dec. 26, 1978

[54] MISSILE SYSTEM

[75] Inventor: Charles R. Dietz, Sunnyvale, Calif.

[73] Assignee: The United States of America as represented by the Secretary of the Navy, Washington, D.C.

[21] Appl. No.: 804,036

[22] Filed: Jun. 6, 1977

[51] Int. Cl.[2] ..... F42B 15/10

[52] U.S. Cl. ..... 102/49.4

[58] Field of Search ..... 102/49.3, 49.4, 49.5, 102/49.6, 49.7, 56, 67

[56] References Cited

U.S. PATENT DOCUMENTS

| | | | |
|---|---|---|---|
| 3,170,655 | 2/1965 | Pierce | 102/49.5 |
| 3,260,204 | 7/1966 | Wilkey, Jr. | 102/49.5 |

*Primary Examiner*—Verlin R. Pendegrass

*Attorney, Agent, or Firm*—R. S. Sciascia; Charles D. B. Curry; Francis I. Gray

[57] ABSTRACT

A missile system with geometric constraints having a plurality of booster stages in tandem and carrying a segmented payload which is situated in the annular area between the last stage booster motor, which is smaller in diameter than the booster motors of preceding stages, and the missile skin.

2 Claims, 3 Drawing Figures

( PRIOR ART,
NO GEOMETRIC CONSTRAINT )

MISSILE SYSTEM

BACKGROUND OF THE INVENTION

1. Field of the Invention

The present invention relates to missile systems, and more particularly to multi-stage missile systems having geometrical constraints.

2. Description of Prior Art

Rocket motors tend to be most efficient when they are long and skinny, with ratios of 4:1 to 5:1 length to diameter being in the realm of the most efficient. With ratios greater than 5:1 vibration problems and propellant grain problems occur which reduce the efficiency. For lower ratios the weight of the motor case, particularly the dome plate on the end opposite the nozzle, causes a reduced efficiency.

For conventional fixed site missiles with no geometric constraints each subsequent stage is approximately one-third the weight of the preceding stage and results in a stepped configuration (FIG. 1), each stage with near optimum length to diameter ratios. For missiles which are required to be readily transportable or which are launched from tubes having geometrical limitations, the geometrical limitations result in a missile wherein the ratios for the motors are not optimum. For example, FIG. 2 shows a missile which is geometrically constrained to a fixed length, L, and a constant diameter, D. This missile has two boost stages, with the first stage motor having a 3:1 ratio, close to optimum, and the second stage motor having a 1:1 ratio. The payload is located forward of the boost stages in the length, l.

Within the geometrical constraints imposed it is desired to obtain greater range. In addition to the restraints of length and diameter, the maximum weight sustainable by the transport bed and/or the launch platform must be considered, as well as the size of the payload.

SUMMARY OF THE INVENTION

Accordingly, the present invention provides a missile system which has an additional boost motor. This boost motor is located axially and in parallel with the payload, has a diameter less than that of the preceding stages, and has a close to optimum length to diameter ratio. The payload is fragmented and located in the annular area between the motor and the missile skin.

Therefore, it is an object of the present invention to provide a missile system with a greater range within the same geometrical constraints of prior missile systems.

Other objects, advantages and novel features of the present invention will be apparent from the following detailed description when read in light of the accompanying drawing and claims.

DESCRIPTION OF THE PREFERRED EMBODIMENT

Figure 1:
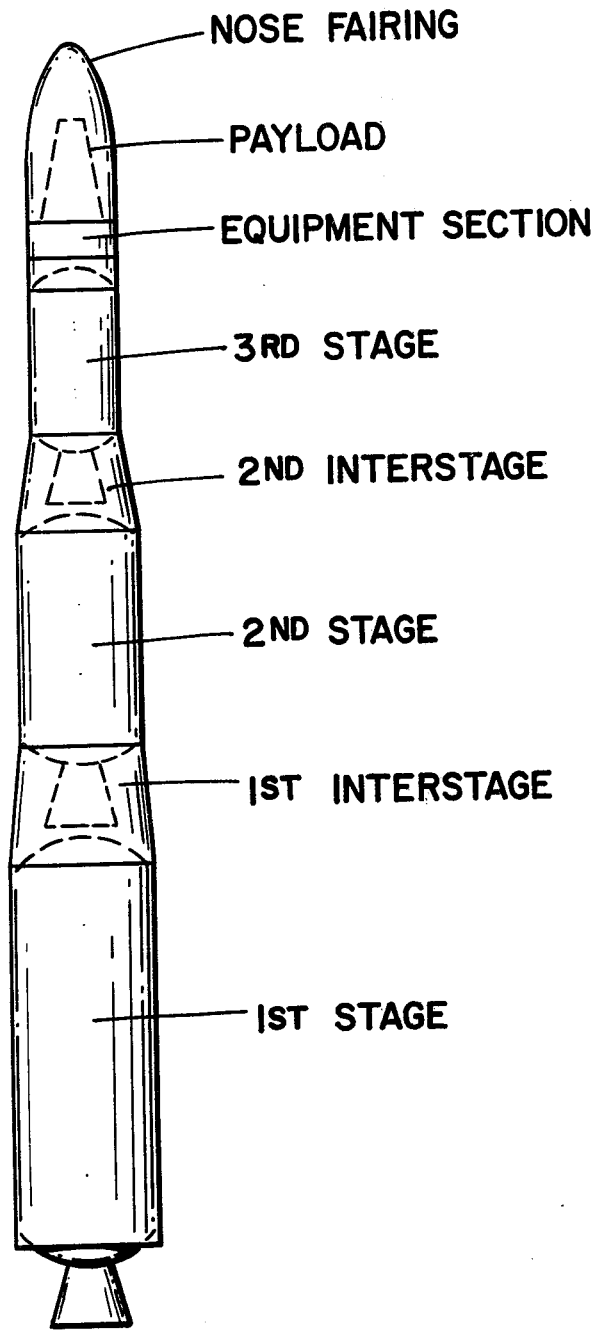
FIG. 1 is a pictorial representation of a conventional multi-stage rocket vehicle without geometric constraints.
Figure 2:
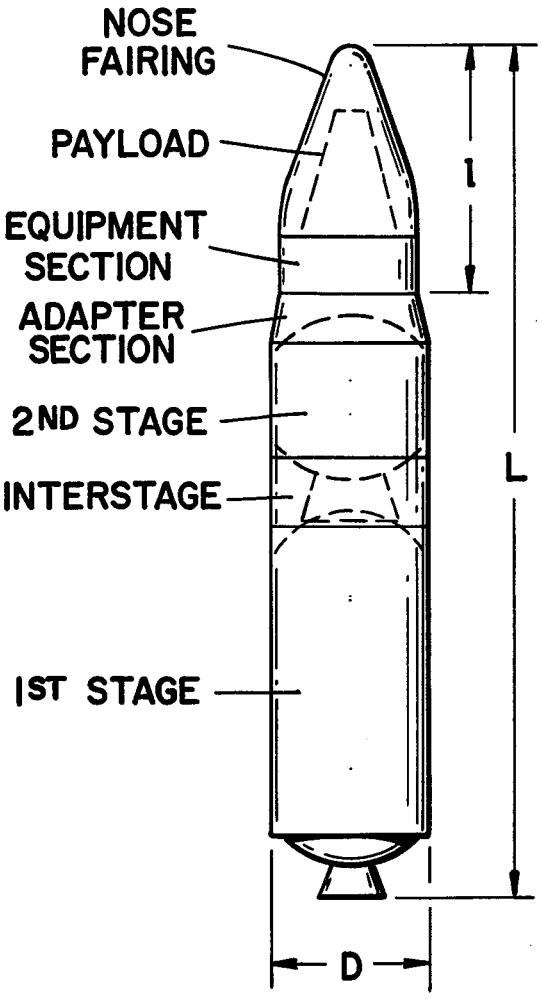
FIG 2 (PRIOR ART)
FIG. 2 is a pictorial representation of a prior art multi-stage rocket vehicle with geometric constraints.
Figure 3:
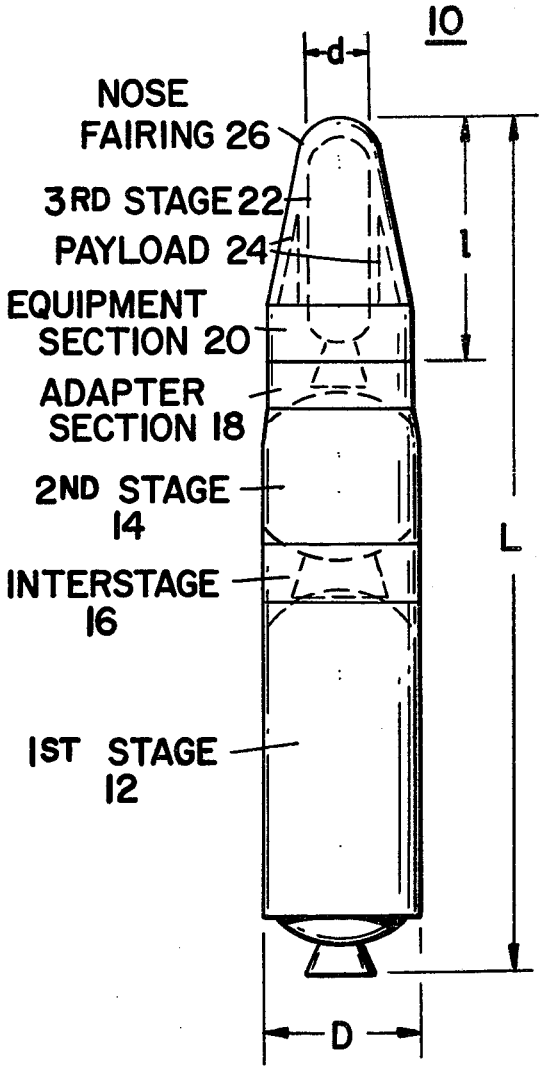
FIG. 3 is a pictorial representation of a multi-stage rocket vehicle with geometric constraints according to the present invention.

Referring now to FIG. 3 a missile system 10 is shown having length L and diameter D geometric restrictions the same as the prior art missile system of FIG. 2. The missile 10 has the same first stage 12 and second stage 14 connected in tandem by an interstage 16 as the prior art missile. An adapter section 18 connects the second stage 14 to an equipment section 20 which serves as a platform for the payload package.

A third stage 22 is now added centrally to the equipment section 20 and a plurality of payloads 24 is mounted on the equipment section in the annular space around the third stage. A nose fairing 26, attached to the equipment section 20, encloses the third stage 22 and the payloads 24 to protect them during passage through the atmosphere. The third stage 22 is made to closely approximate the ideal length to diameter ratio for maximum efficiency. The result is a significant increase in range due to the addition of the third stage 22 within the length l which formerly contained only a payload with only a small increase in the launch weight of the missile 10.

The constraints upon the third stage 22 are determined by the optimum geometric ratios for the motor, i.e., the diameter d of the third stage being greater than or equal to one-third of the diameter of the preceding stage ($d \geqq \frac{1}{3}D$) with the length to diameter ratio (l/d) approaching optimum (4:1 to 5:1), and the amount of space required for the payloads 24. It is apparent that some payload capability is given up, but this loss is more than offset by the twenty-five percent (25%) increase in range with only a five percent (5%) increase in launch weight. For $l = 34$ ft and $D = 6$ ft a two stage geometry was optimum previously with $l = 10$ ft and a launch weight of approximately 65,000 pounds. Under the present concept the geometrical restraints remain the same but a third stage 22 is added, having an l/d of approximately 3.5:1. The missile launch weight is 70,000 pounds, 4,000 pounds of which is the motor of the added third stage 22.

It should be noted that the third stage 22 is in addition to any post boost propulsion system (PBPS) contained in the equipment section 20 and performs a different function. The third stage 22 provides additional boost thrust to increase range, while the PBPS provides velocity and attitude spacing between payload 24 separations.

Thus, the present invention provides a significant increase in range within specific geometric and weight constraints over prior missile systems.

What is claimed is:

1. An improved missile system of the type having a plurality of booster stages mounted in tandem and a payload stage with a plurality of separable payloads, said booster and payload stages being confined within a missile skin of a geometrically constrained configuration, wherein the improvement comprises:

a booster rocket motor of near optimum length to diameter ratio axially mounted within said payload stage in tandem with said booster stages, said separable payloads being mounted on said payload stage in an annular area between said booster rocket motor and said missile skin, to provide greater range for said missile system within said geometrically constrained configuration.

2. An improved missile system as recited in claim 1 wherein said booster rocket motor has a diameter less than the diameter of the rocket motor of the prior booster stage and greater than approximately one-third of the diameter of said prior booster stage to provide said annular area for said separable payloads and a length to achieve a length-to-diameter ratio of between 3:1 to 5:1.

* * * * *